US010544523B2

(12) United States Patent
Coral

(10) Patent No.: US 10,544,523 B2
(45) Date of Patent: Jan. 28, 2020

(54) DEVICE FOR KEEPING AN INACCESSIBLE ELEMENT TO BE STABILISED STATIONARY IN A REQUIRED ANGULAR POSITION AND USE OF THE DEVICE IN A MACHINE FOR PROCESSING TEXTILE THREADS

(71) Applicant: Saurer Technologies GmbH & Co. KG, Krefeld (DE)

(72) Inventor: Gilles Coral, Beaumont les Valence (FR)

(73) Assignee: Saurer Technologies GmbH & Co. KG, Krefeld (DE)

( * ) Notice: Subject to any disclaimer, the term of this patent is extended or adjusted under 35 U.S.C. 154(b) by 660 days.

(21) Appl. No.: 14/783,693

(22) PCT Filed: Apr. 3, 2014

(86) PCT No.: PCT/FR2014/050807
§ 371 (c)(1),
(2) Date: Oct. 9, 2015

(87) PCT Pub. No.: WO2014/167221
PCT Pub. Date: Oct. 16, 2014

(65) Prior Publication Data

US 2016/0047068 A1 Feb. 18, 2016

(30) Foreign Application Priority Data

Apr. 10, 2013 (FR) ..... 13 53208

(51) Int. Cl.
*D01H 7/86* (2006.01)
*D02G 3/28* (2006.01)
(Continued)

(52) U.S. Cl.
CPC ..... *D01H 7/862* (2013.01); *D01H 7/864* (2013.01); *D02G 3/285* (2013.01); *H01F 2007/1684* (2013.01); *H01F 2007/185* (2013.01)

(58) Field of Classification Search
CPC ..... D01H 7/862; D01H 7/864; D01H 13/14
See application file for complete search history.

(56) References Cited

U.S. PATENT DOCUMENTS 2,684,566 A * 7/1954 Roberts ..... D01H 7/862 57/58.76
3,264,813 A * 8/1966 Mackie ..... D01H 1/101 57/58.72

(Continued)

FOREIGN PATENT DOCUMENTS

DE 10 2009 042 777 A1 4/2011
EP 1 045 053 A1 10/2000

(Continued)

*Primary Examiner* — Shaun R Hurley
(74) *Attorney, Agent, or Firm* — Nelson Mullins Riley & Scarborough LLP

(57) ABSTRACT

At least two pairs of magnets are arranged near one another on supports, the pairs of magnets and the supports form, when an item to be stabilized is in a required angular position, a closed magnetic circuit (except for the air gap), with magnets placed in such a direction that their north and south poles successively alternate with one another along the magnetic circuit, an item, sensitive to the magnetic field, is attached to the fixed part and placed inside the closed magnetic circuit, the sensitive item supplies a logic output state corresponding to the "item to be stabilized in the required angular position" when the detected field is less than a predetermined maximum threshold, and a logic state corresponding to the "item to be stabilized not in the required angular position", when the detected field is greater than a minimum predetermined threshold.

8 Claims, 4 Drawing Sheets

(51) Int. Cl.
*H01F 7/16* (2006.01)
*H01F 7/18* (2006.01)

(56) References Cited

U.S. PATENT DOCUMENTS 3,338,043 A * 8/1967 Franzen ..... D01H 7/862 57/58.76
3,343,359 A * 9/1967 Franzen ..... D01H 1/427 57/356
3,368,337 A * 2/1968 Franzen ..... D01H 7/862 57/356
3,456,432 A * 7/1969 Nimtz ..... D01H 1/166 57/356
3,648,449 A * 3/1972 Greive ..... D01H 7/86 57/58.76
4,091,606 A 5/1978 Böttcher
4,283,907 A * 8/1981 Pelin ..... D01H 7/864 57/58.76
4,592,195 A 6/1986 Charbonnier
4,608,620 A * 8/1986 Hines ..... H01H 47/04 361/154
5,014,505 A * 5/1991 Wernli ..... D01H 9/003 57/264
5,361,571 A * 11/1994 Joyce ..... D01H 7/862 57/58.76
6,249,418 B1 * 6/2001 Bergstrom ..... F01L 9/04 361/152
8,159,807 B2 * 4/2012 Pohl ..... H01F 7/1615 361/160

FOREIGN PATENT DOCUMENTS

EP 1 847 637 A2 10/2007
FR 2 565 261 A1 12/1985
FR 2 914 320 A1 10/2008
FR 2 937 056 A1 4/2010
FR 2 931 486 B1 6/2010
FR 2 931 346 B1 8/2010
JP 59-86566 A 5/1984

* cited by examiner

DEVICE FOR KEEPING AN INACCESSIBLE ELEMENT TO BE STABILISED STATIONARY IN A REQUIRED ANGULAR POSITION AND USE OF THE DEVICE IN A MACHINE FOR PROCESSING TEXTILE THREADS

BACKGROUND

Technical Field

The invention concerns primarily, but is not limited to, the technical domain of machines for the transformation of continuous elongated materials, in particular textile yarn, according to the so-called "double twist" or "direct cabling" method and the devices used for implementing these methods.

Description of the Related Art

The "double twist" or "direct cabling" methods are well known to the man of the art.

The "double twist" method is illustrated schematically in FIG. 1. A yarn F1 is paid out from a bobbin 1 placed in a fixed pot or a fixed carrier 2, enters into a hollow shaft of rotating spindle 3, leads out through the hole 5 then connects to a fixed point 10, while forming, under the effect of rotation and therefore of the centrifugal force, a ball 7 around the pot 2. Under the rotational effect of the spindle 3, the yarn F1 is twisted twice around itself per turn of the spindle.

The "direct cabling" method is illustrated schematically in FIG. 2. A yarn F1 is paid out from a bobbin which is not shown, enters into the hollow shaft of rotating spindle 3, leads out through the hole 5 then back up to a fixed point 10, while forming, under the effect of rotation and therefore of the centrifugal force, a ball 7 around the pot 2. A second yarn F2 is paid out from a bobbin 1 placed in the pot or fixed carrier 2 and connects with the yarn F1 at the fixed point 10. Turned by the action of spindle 3, the yarn lengths F1, F2 assemble to form a cabled design, with one yarn wound about the other per turn of the spindle.

In both cases, the yarn F1, or the yarn F1, F2 passes or pass through one or several braking devices 4, 6, in particular to balance the tension due to the centrifugal force of the yarn F1 forming the ball 7.

In both cases, the twisting or assembly by twisting of the basic yarn or yarn lengths is therefore effected by putting into rotation the yarn F1 through spindle 3, with said yarn F1, forming, under the effect of the rotation and the centrifugal force, the ball 7 around the pot or carrier 2, containing at least one bobbin of one of the basic yarn lengths to be transformed. This fixed pot 2, is arranged on spindle 3 rotating through a bearing 8, and is fully enclosed by the rotating yarn F1 forming the ball 6. Said pot 2, which is inaccessible by conventional mechanical means, must therefore be held stationary, that is, prevented from turning about itself under the effect of friction in the bearings of bearing 8 or with yarn F1.

Many means have been proposed to maintain stationary a pot mounted to a rotating spindle and rendered inaccessible by the yarn rotating in the form of a ball around it. In particular, one known embodiment consists in using the attraction force of magnets, for instance, by arranging at least one pair of magnets 9, one fastened in the pot 1 and the other fastened to the frame of the machine. Said magnets are arranged so that the poles having opposing polarities face each other and generate a mutual attraction which tends to maintain the pot 1 in a fixed angular position, and in such a way that the path of the yarn F1 forming the ball 6 passes through the air gap between the two magnets.

To generate sufficient return attraction torque, there is a known art of combining several pairs of magnets, represented symbolically in the figures by the pair of magnets 9, arranged on metal supports suitable for organizing and concentrating the magnetic fluxes and thus increasing the forces of attraction.

In the following description, the terms "item to be stabilized" will refer to the item mounted to a rotating device via a bearing which must be kept stationary and the term "stabilization" to the function consisting in preventing it from turning. In the above, the "item to be stabilized" is the pot 1 and the "rotating device" is the spindle 3

As indicated in the French patent FR2565261, for some "direct cabling" applications intended to form a cabled length for technical applications demanding accurately-controlled twisting characteristics, there is a known embodiment using a set of means which, when combined, ensure equal tension between the elementary yarn wound in the pot and the elementary yarn coming from the ball. Essentially, these means include:

- on the one hand, a brake 4 capable of imparting to yarn F2 leading from the pot, a perfectly stable tension equal to that of the yarn forming the ball, resulting from centrifugal force and the aerodynamic drag of the yarn. In a customary manner, this brake 4 is arranged in pot 2.
- on the other hand, a rotating device 11, generally driven in rotation by yarn F1, comprising a set of pulleys synchronized together, on which the two yarn lengths F1, F2 wind, to equalize their speed of progress before their assembly. In a known embodiment, this rotating device 11, hereinafter referred to as the "regulator", is attached either to the machine frame by a bearing 15, or to the pot 1 by means of a bearing 15.

FIG. 3 is a schematic illustration of a solution in which the "regulator" 11 is attached to the frame of the machine by a bearing 15. FIG. 4 is a schematic illustration of a solution in which the "regulator" 11 is attached to pot 1 by a bearing 16.

According to an improvement, conforming to the information gathered from patent FR2931346 and as illustrated in FIG. 5, it has been proposed to attach the "regulator" 11 to the machine frame by means of bearing 15 and to attach brake 4 to "regulator" 11 by means of bearing 16.

According to this improvement, the brake 4, which is made inaccessible by the yarn in rotation forming a ball around it, must therefore be held stationary, that is prevented from turning about itself under the effect of friction in the bearings of bearing 16 or with yarn F1. In this case, the "item to be stabilized" is the brake 4, and the rotating device is the "regulator" 11.

It has been a proposed to use the attraction force of magnets, for instance by setting up at least one pair of magnets symbolically represented in the diagrams by the pair of magnets 24, one attached to the machine frame and the other attached to the brake 4. Said magnets are arranged in such a way that the poles having opposite polarities are placed opposite each other and generate mutual attraction, tending to hold brake 4 in a fixed angular position and so that the path taken by yarn F1 forming ball 6 passes through the air gap between the two magnets.

According to the embodiments proposed in the prior art for obtaining the "stabilization" function using the mutual attraction of one (or several) pair(s) of magnets, the item to be stabilized, before the twisting equipment is put into rotation, can be pre-positioned in a multitude of stable positions.

Among these stable angular positions, taking the principle of stabilization into consideration, only stable positions in which the magnets are correctly positioned with respect to each other ensure sufficient attraction force for said item to be stabilized to remain stationary. If the item to be stabilized is pre-positioned in an incorrect stable position which supplies insufficient return attraction force, it is liable to begin rotation under the effect of friction in the bearing or under the effect of the friction of the yarn on its surface.

In some application cases, it is also necessary that the item to be stabilized is oriented suitably, for instance so that the operator has visual access to the devices installed on said stabilized item. In particular, in the case of a double twist or direct cabling method, it is important for pot 1 to be oriented so that brake 4 is visible from the front of the machine to check the correct adjustment or the correct passage of the yarn.

In the light of the above, in the following we will refer to the position or positions providing the stabilization conditions and/or the working conditions defined for the application as the required angular position(s).

More specifically, the invention concerns means of ensuring that an "item to be stabilized", attached to a rotating device by means of a bearing, and inaccessible by conventional mechanical means,

- is correctly positioned in a required angular position before the said rotating device is put into rotation.
- is held stationary by using the attraction force of magnets,
- remains positioned in the said required angular position during rotation.

Patent EP1847637 describes a means of detecting the putting into rotation of the pot by means of twisting equipment. According to the proposed embodiment, applicable if the pot is prevented from rotating by the mutual attraction of a pair of magnets, the said patent proposes having a magnetic field sensor capable of detecting the passage of the magnet placed in the pot, when the latter is put into rotation. The information in this patent indicates that the issue of detecting whether the pot remains stationary or not is resolved but not the issue of checking that the pot is correctly positioned before the twisting equipment is put into rotation.

In addition, according to the information gathered from this patent EP1847637, for rotation to be detected, the pot must have rotated through a significant angle. Taking into consideration the inertia of the pot and the bobbin it contains, and therefore its low acceleration capability, the time required for reaching the detection point may extend from several tenths of a second to several seconds before stoppage is initiated.

In the case described previously, conforming to the information gathered from patent FR2931486 and illustrated in FIG. 5, in which a rotating "regulator" 11 is attached to the machine frame by means of a bearing 15 and a brake 4 is attached to the "regulator" by means of bearing 16, there arises the issue of ensuring that the brake 4 is in the required angular position before the twisting equipment is put into rotation and remains in the required angular position during rotation. However, an issue like this is far more critical than for the pot 1. Indeed, because of its small diameter and its light weight, and thereby its very low inertia, the pot has a very high acceleration capability under the effect of, for instance, the impulse given by yarn F1 which wraps around it to form the ball 7 in the event of breakage or transient instability.

Therefore, there is an issue of detecting whether the brake 4 is in the required angular position and of detecting very quickly if it moves away from it, without waiting for it to rotate through any significant angle.

BRIEF SUMMARY

However, we have discovered, and that is the subject of this invention, a specific arrangement of magnets and sensors sensitive to the magnetic fields which ensures, in a safe and economical manner, a way of maintaining stationary in the required angular position, an "item to be stabilized" which is inaccessible using conventional mechanical means, arranged on a rotating device by means of a bearing and using the force of attraction between the said magnets, and of ensuring:

- that the item to be stabilized is in the required angular position before the rotating device is put into rotation.
- that the item remains in the required angular position during rotation.

According to the invention, a device has been designed to maintain stationary, in a required angular position, an item to be stabilized, inaccessible by conventional mechanical means, arranged on a device rotating through a bearing, using the attraction force of a multitude of pairs of magnets placed facing each other, with each pair comprising a magnet integral with the item to be stabilized and a magnet integral with the fixed part. More specifically:

- at least two pairs of magnets are arranged near one another on materials having low reluctance,
- the said magnets and the said metal supports form, when the item to be stabilized is in the required angular position, a closed magnetic circuit (except for the air gap), with the magnets oriented so that their north and south poles successively alternate with one another along said magnetic circuit,
- said closed magnetic circuit is generally symmetrical with respect to an axis or a radial plane with respect to the axis of rotation of the rotating device,
- an item sensitive to the magnetic field is attached to the fixed part and placed inside the closed magnetic circuit formed when the item to be stabilized is in the required angular position, and in the axis or the radial plane of symmetry of the said circuit,
- said sensitive item supplies a logic output state corresponding to the "item to be stabilized in the required angular position" when the detected field is less than a predetermined maximum threshold, and a logic state corresponding to the "item to be stabilized not in the required angular position", when the detected field is greater than a predetermined minimum threshold.

According to one embodiment of the invention, the item sensitive to the magnetic field is a Hall effect sensor combined with a processing circuit defining a logic output state according to a threshold level of the measured magnetic field.

According to another embodiment of the invention, the item sensitive to the magnetic field is a switch, known to the man of the art as a "reed switch" (ILS), switched by the magnetic field to which it is exposed, with the logic output state being defined by the open or closed state of said reed switch.

According to an advantageous embodiment of the invention, the item sensitive to the magnetic field is a reed switch of the "normally closed" type, that is, closed when there is no magnetic field and open when there is a magnetic field, said switch being inserted in series with the control circuit of the motor so that it is not powered when the said switch is open.

The invention also concerns the use of the device in a machine for transforming textile yarn using the double twist or direct cabling method.

In the case of a double twist method, using a spindle to which a pot is attached by a bearing, with said pot being rendered inaccessible by the yarn rotating to form a ball around it, in which the item to be stabilized is the pot, with the logic state imparted to a means of driving the said spindle so that the logic state corresponding to the "item to be stabilized (the pot) in the required angular position" enables rotation and maintaining in rotation of the spindle, and the logic state of the "item to be stabilized (the pot) not in the required angular position" prohibits the rotation of the spindle or causes its stoppage if this state appears while it is in rotation.

In the case of a direct cabling method, implementing a spindle, a rotating regulator, driven by the ball yarn, and a brake attached to said rotating regulator via a bearing, said brake being rendered inaccessible by the yarn rotation to form a ball around it, the item to be stabilized is the brake, with the logic state being imparted to the driving device of the said spindle so that the "item to be stabilized (the brake) in the required angular position" logic state enables rotation of the spindle and maintains it in rotation, and the logic state of the "item to be stabilized (the brake) not in the required angular position" prohibits the rotation of the spindle and therefore of the regulator, or causes their stoppage if this state appears while it is in rotation.

In the case of a direct cabling method, implementing a spindle to which a pot is attached by a bearing, a rotating regulator driven by the yarn of the ball, and a brake attached to said rotating regulator by a bearing, said pot and said brake being rendered inaccessible by the yarn in rotation forming a ball around it, the item to be stabilized comprises the pot and the brake, with the logic states being combined and imparted to the driving device of the said spindle so that the logic state of "the two items to be stabilized (the pot and the brake) in the required angular position" enables rotation of the spindle and maintains it in rotation, and therefore through the yarn of the ball the regulator, and so that the logic state of "one of the items to be stabilized (the pot or the brake) outside the required angular position" prohibits the rotation of the spindle and therefore of the regulator or causes their stoppage if this state appears while it is in rotation.

According to one improvement of the invention, since the spindle is associated with a driving device associated with a braking device, the appearance of the logic state of "item to be stabilized not in the required angular position" causes the stoppage of the driving device and the actuation of the braking device to ensure a fast stoppage.

BRIEF DESCRIPTION OF THE SEVERAL VIEWS OF THE DRAWINGS

The invention will be more understandable by reference to the attached illustrations given as an example and in which.

DETAILED DESCRIPTION

Therefore, the invention concerns a device designed to maintain in a required stationary position an item attached by a rotating device through a bearing, said item being inaccessible by conventional means and to detect:

- that the item to be stabilized is in the required angular position before the rotating device is put into rotation.
- that it remains in the required angular position during the rotation of said rotating device.

The invention is more particularly intended for machines transforming textile yarn using the "double twist" or "direct cabling" methods as illustrated in FIGS. 1 to 5.

The device referred to in the invention is intended, on the one hand, to maintain stationary in the required angular position, a pot 2 attached to a twisting spindle 3 through a bearing 8 and made inaccessible by the rotating yarn F1 in the form of a ball 7 around it, according to any one of the arrangements illustrated in FIGS. 1 to 5 and, in addition, to detect:

- that it is in the required angular position before the spindle 3 is put into rotation.
- that it remains in the required angular position during the rotation of spindle 3.

Figure 1:
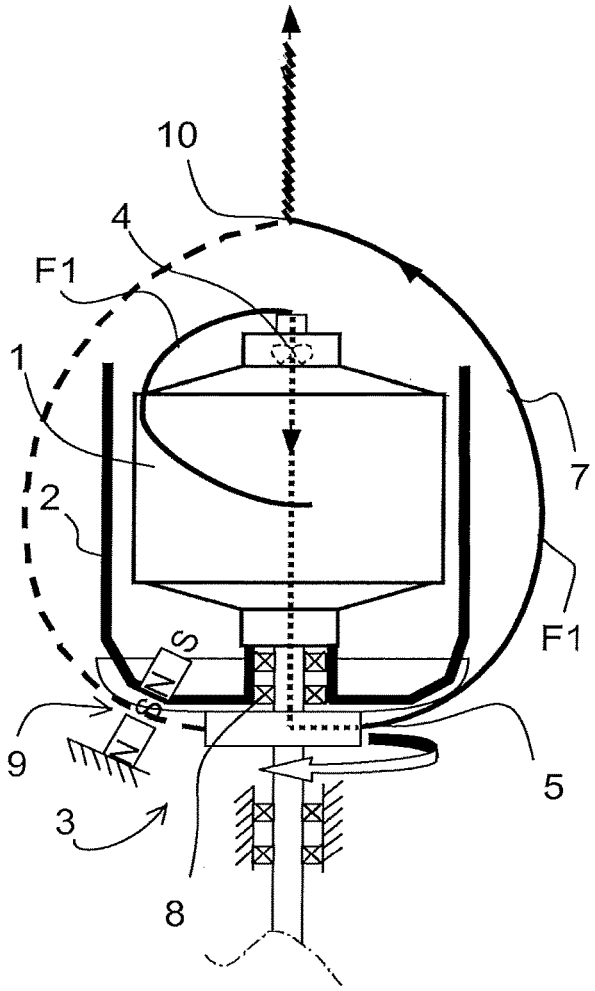
PRIOR ART FIG 1
FIG. 1 is a general diagram explaining the double twist method.
Figure 2:
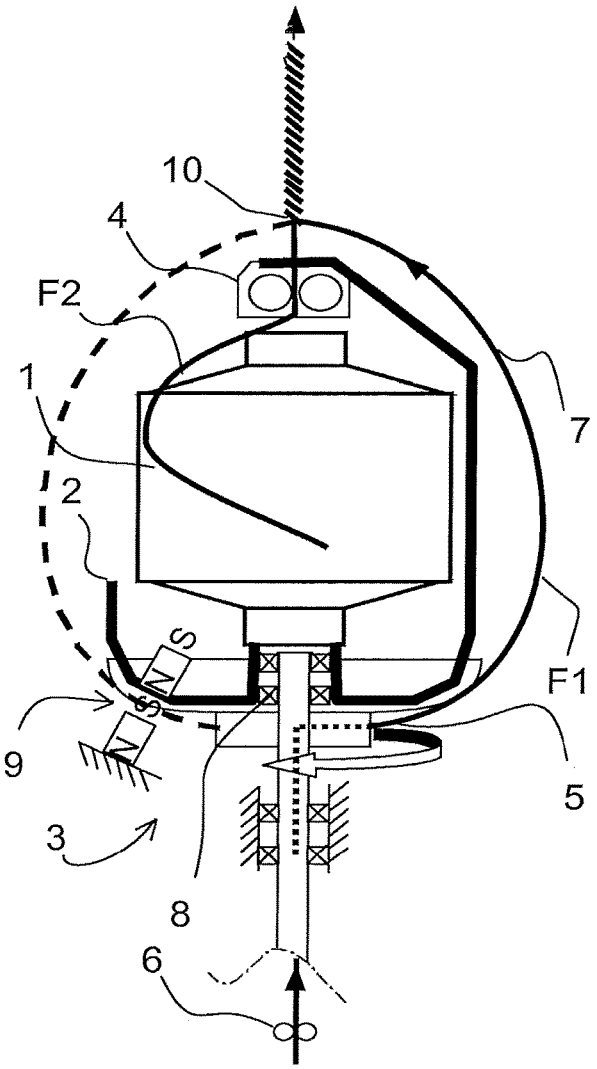
PRIOR ART FIG 2
FIG. 2 is a general diagram explaining the direct cabling method.
Figure 3:
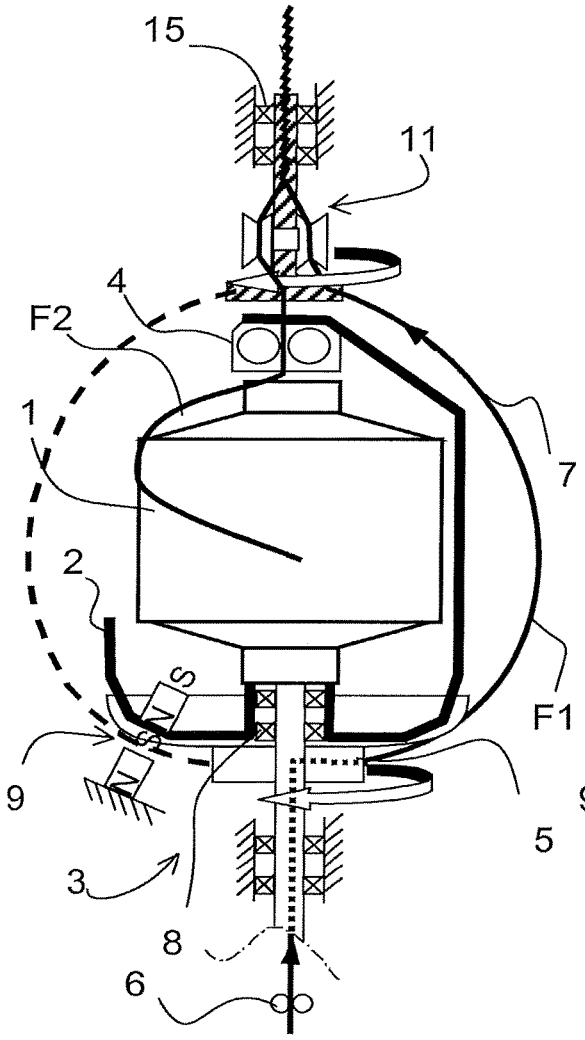
PRIOR ART FIG 3
FIG. 3 is a general diagram explaining the direct cabling method using a regulator attached to the pot.
Figure 4:
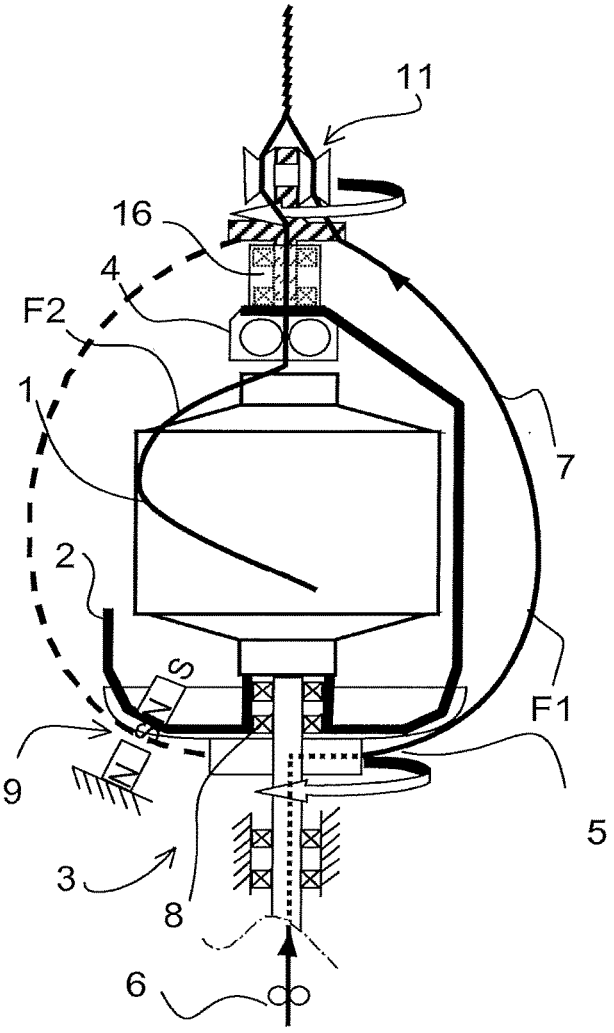
PRIOR ART FIG 4
FIG. 4 is a general diagram explaining the direct cabling method using a regulator attached to the machine frame.
Figure 5:
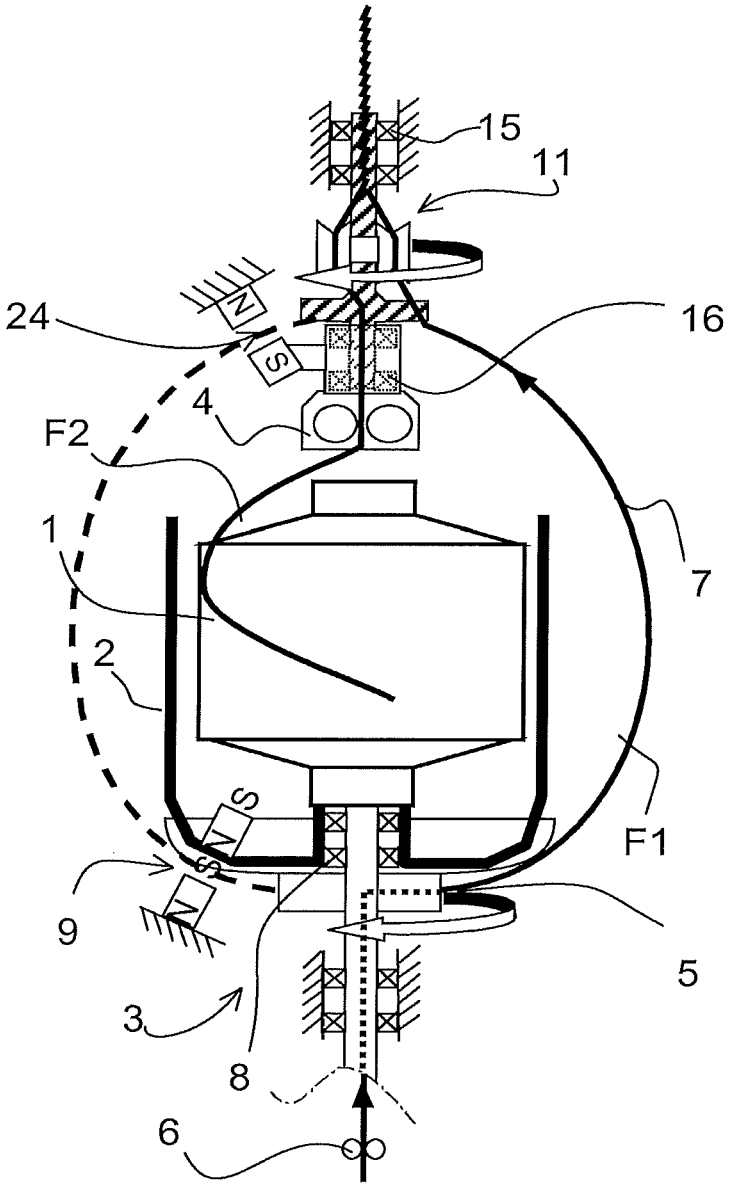
PRIOR ART FIG 5
FIG. 5 is a general diagram explaining the direct cabling method using a regulator attached to the machine frame and a brake attached to the regulator.

The device referred to in the invention is also designed to maintain stationary in the required angular position the brake 4 attached to a twisting regulator 11 by means of a bearing 16 and rendered inaccessible by the rotating yarn F1 in the form of a ball 7 around it, according to the arrangement illustrated in FIG. 5, and to detect

- that it is in the required angular position before the spindle 3 is put into rotation.
- that it remains in the required angular position during the rotation of spindle 3.

Figure 6:
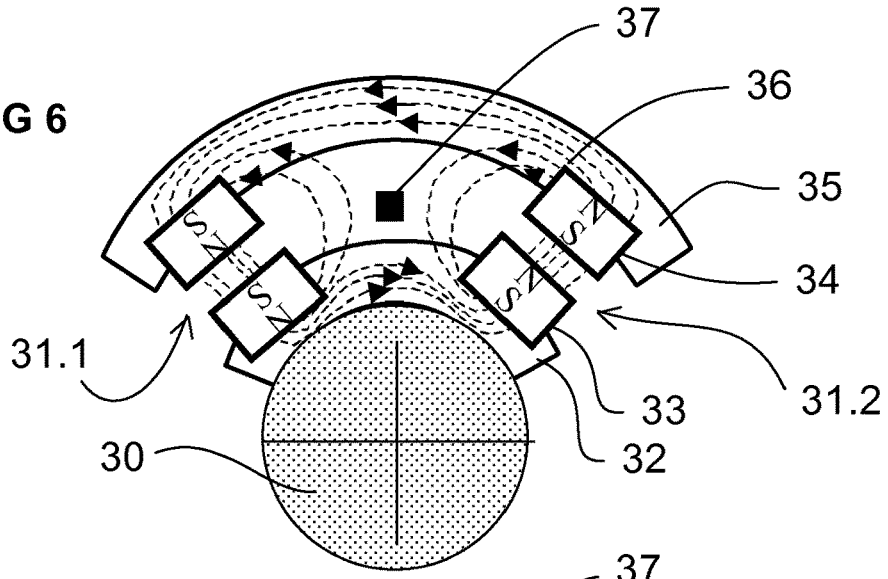
FIG. 6 is a diagram representing the configuration of the magnets and the organization of the magnetic fluxes in a device according to the invention, when the item to be stabilized is in the required angular position.
Figure 7:
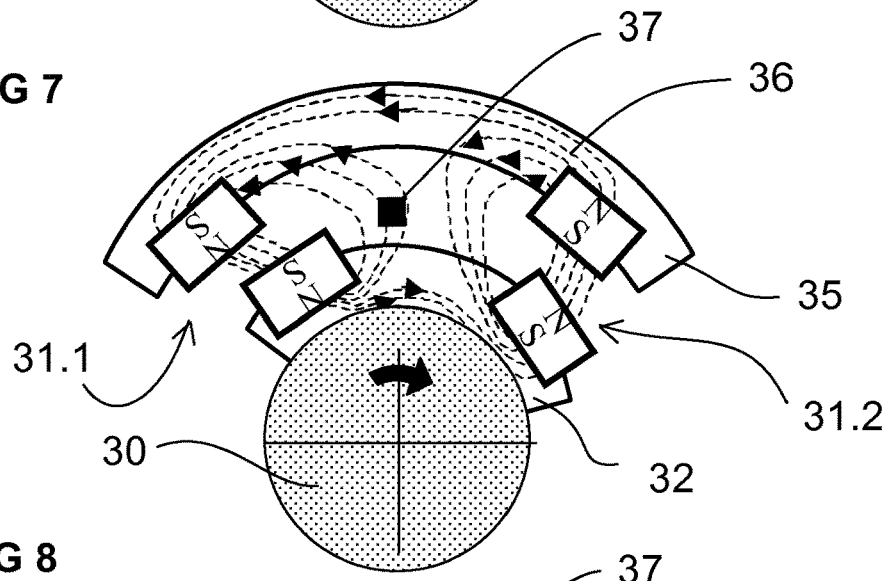
FIG. 7 is a diagram representing the configuration of the magnets and the organization of the magnetic fluxes in a device according to the invention, when the item to be stabilized is not in the required angular position.
Figure 8:
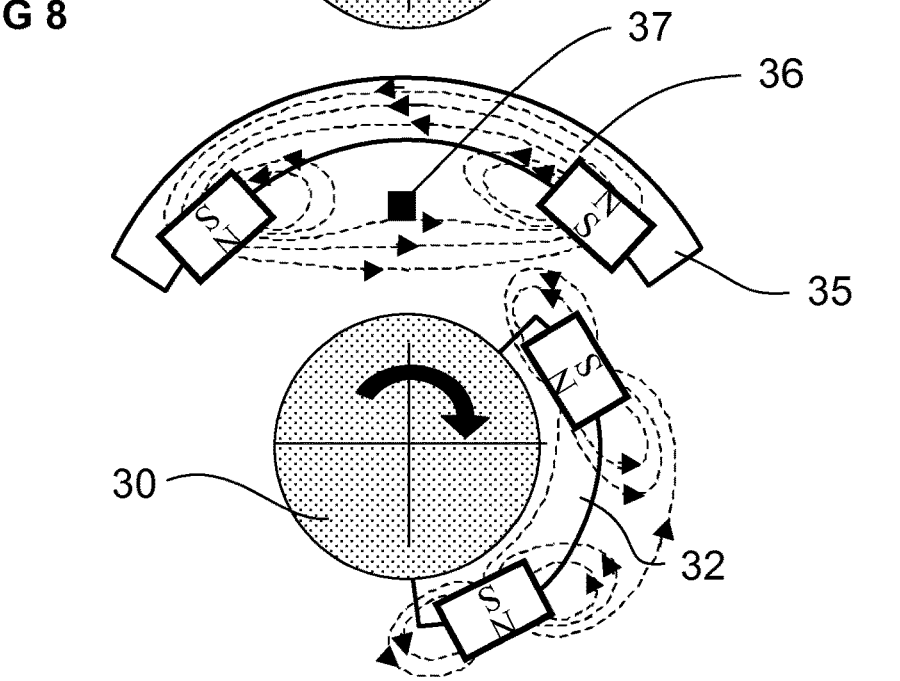
FIG. 8 is a diagram representing the configuration of the magnets and the organization of the magnetic fluxes in a device according to the invention, when the item to be stabilized is in a second type of position in the required angular position.

The device according to the invention will be better understood by reference to FIGS. 6, 7 and 8. More generally, the device is designed to maintain stationary in a required angular position, an item 30 attached to a rotating device (not shown) through a bearing (not shown) and to detect that it is, and remains, in the said required angular position.

The item to be stabilized 30 is held stationary using the mutual attraction force of the pairs of magnets 33, 34, one of which 33 is integral with the item to be stabilized 30, while the other 34 is integral with a fixed item, for instance, the frame of a machine (not shown).

FIG. 6 shows the device when the item to be stabilized (30) is in the required angular position. According to the invention, at least two pairs of magnets (31.1, 31.2) are arranged near one another. The magnets (33, 34) are arranged on metal supports (32, 35) or made of materials with low reluctance, so that magnets (33, 34), forming the two pairs of magnets (31.1, 31.2), associated with the said metal supports (32, 35), form, when the item to be stabilized (30) is in the required position, a closed magnetic circuit (except for the air gap). The magnets are placed so that their north and south poles successively alternate with one another along said magnetic circuit, which is closed since it is generally symmetrical compared to an axis or a radial plane with respect to the axis of rotation of the rotating device.

Accordingly, in the required angular position, the closed magnetic circuit formed in this way organizes the magnetic fluxes along the lines of fields 36 the form of which is given for information. Because of the relatively low reluctance of the components of this closed magnetic circuit, it concentrates a large share of the magnetic flux, and because of the symmetry of the magnetic circuit with respect to a radial axis or plane with respect to the axis of rotation of the rotating device, the magnetic flux along this axis or this plane of symmetry is generally nil when the item to be stabilized is in the required angular position.

An item 37, sensitive to the magnetic field, is attached to the fixed part (integral with the machine frame), and placed inside the closed magnetic circuit formed when the item to be stabilized is in the required angular position, and in the radial axis or plane of symmetry of the said circuit. Under these conditions, item 37 detects a nil or very weak magnetic field.

The magnetic field being less than a predetermined threshold, said item 37 sensitive to the magnetic field, then supplies a logic state corresponding to "item to be stabilized in the required angular position".

FIG. 7 shows the device when the item to be stabilized 30 moves away slightly from the required angular position. The magnets 33, 34 of the two pairs of magnets 31.1, 31.2 misalign which tends to increase the length and reluctance of the closed magnetic circuit. On the other hand, said magnetic circuit formed by the magnets 33, 34 and their metal supports 32, 25, is no longer symmetrical with respect to a radial axis or plane with respect to the axis of rotation of the rotating device. Under these conditions, when the item to be stabilized is angular and offset with respect to the required position, the magnetic field is asymmetrical.

Accordingly, as soon as the mobile item 30 moves away from the required angular position, the closed magnetic circuit organizes the magnetic fluxes along the field lines 36, whose form, given for information, becomes asymmetrical. Because of the higher reluctance of this closed magnetic circuit, a larger share of the field lines loop outside the said circuit. This results in the magnetic flux along the axis for this plane of symmetry defined previously no longer staying nil.

Under these conditions, the item 37 sensitive to the magnetic field, attached to the fixed part (integral with the machine frame), and arranged inside the closed magnetic circuit in the radial axis or plane of symmetry defined previously detects a non-nil magnetic field.

The magnetic field being greater than a predetermined threshold, said item sensitive to the magnetic field then supplies a logic state corresponding to an "item to be stabilized in the required angular position".

FIG. 8 shows the device when the item to be stabilized 30 moves away from the required angular position by a large angle, so that the parts integral with the item to be stabilized 30 and the fixed parts or the parts integral with the frame no longer form a closed magnetic circuit. In this case, the magnetic field 36 created by the magnets integral with the fixed part is no longer channeled by a closed, organized magnetic circuit and the field lines 36 loop around the metal support in forms, such as, for instance, those given for information in FIG. 8. The result is that the magnetic flux around the supports 35 is not nil.

Under these conditions, the item 37 sensitive to the magnetic field, attached to the fixed part integral with the machine frame) and arranged in the position defined previously near the supports 35 detects a non-nil magnetic field.

Since the magnetic field is greater than the predetermined threshold, said sensitive item then supplies a logic state corresponding to an "item to be stabilized in the required angular position".

From these explanations, it transpires that when the item to be stabilized 30 is moved away from the required position, whether through a small angle or a larger angle, the item sensitive to the magnetic field 37 associated with its processing circuit does produce an "item to be stabilized not in required position" logic output state, which can be used to prevent the rotation of the rotating device or to stop it, if this state occurs while it is in rotation.

According to one embodiment of the invention, the item sensitive to the magnetic field 37 is a Hall effect sensor associated with a processing circuit defining a logic output state according to a threshold level of the measured magnetic field.

According to another embodiment of the invention, the item sensitive to the magnetic field 37 is a switch, known to the man of the art as a "reed switch" (ILS), switched by the magnetic field to which it is exposed.

The invention also concerns the use of the device for a machine implementing twisting equipment according to the double twist or direct cabling method as shown in FIGS. 1 to 4. It should be borne in mind that this machine uses a spindle 3 to which a pot 2 is attached by means of a bearing 8. Said pot 1 is held stationary and in the required angular position by the previously described device.

According to the invention, the logic state of the circuit processing the signal transmitted from the sensitive element to the magnetic field 37 is imparted to a system driving said spindle 3 so that the logic state corresponds to the "item to be stabilized (the pot) in the required angular position", enabling the rotation and/or the maintained rotation of the spindle 3, and so that the logic state corresponding to "item to be stabilized (the pot) not in the required angular position" prevents the rotation of the spindle 3 or causes it to stop if the state occurs while it is in rotation.

In the case of a direct cabling method using a spindle 3 and a rotating regulator 11, driven by yarn F1 of ball 7, as shown in FIG. 5, in which a brake 4 is attached to said rotating regulator 11 by a bearing 16 according to the invention, said brake 4 is held stationary and in the required angular position by the previously described device.

According to the invention, the logic state of the circuit processing the signal transmitted from the sensitive element to the magnetic field 37 is imparted to a system driving spindle 3 so that the logic state corresponds to the "item to be stabilized (the brake) in the required angular position", enabling the rotation and/or the maintained rotation of the spindle 3 and therefore, through the yarn F1 of ball 7 the regulator 11, and so that the logic state corresponding to "item to be stabilized (the brake) not in the required angular position" prevents the rotation of the spindle 3 and accordingly of regulator 11 or causes them to stop if the state occurs while it is in rotation.

In the case of a direct cabling method, using a spindle 3 to which a pot 2 is attached by means of a bearing 8, a rotating regulator 11, is driven by yarn F1 of ball 7, and a brake 4 attached to said rotating regulator 11 through a bearing 16. According to the invention, said pot 2 and said brake 4 are held stationary and in their respective required angular positions by two devices described previously.

The logic states of the circuits processing the two devices are combined and imparted to the system driving spindle 3 so that the logic state of the two devices corresponds to the logic state of "two items to be stabilized (the pot and the brake) in the required angular position", enabling the rotation and/or the maintained rotation of the spindle 3 and therefore, through the yarn F1 of ball 7, the regulator 11, and so that the logic state of one of the two devices, corresponding to "one of these two items to be stabilized (the pot or the brake) not in the required angular position" prevents the rotation of the spindle 3 and accordingly of regulator 11 or causes them to stop if the state occurs while it is in rotation.

According to one improvement of the invention, the spindle 3 is associated with a driving device and a braking device and the appearance of the logic state of the "item to be stabilized not in the required angular position" causes the stoppage of the driving device and the actuation of the braking device to ensure a fast stoppage.

According to one particularly advantageous embodiment of the invention, the item sensitive to the magnetic field 37 is a reed switch (ILS). This switch is selected as being "normally closed," that is, closed when there is no magnetic field and open when there is a magnetic field. It is inserted directly into the power supply circuit or into the control circuit of the motor driving the rotating device. As an example which should not be considered limiting in any way, such a switch can be connected in series in the power supply circuit of the motor power supply relay coil so that the said relay opens when the magnetic field is not nil, corresponding to the "item to be stabilized not in the required position" state.

While remaining within the scope of the invention, the stabilization force of the items to be stabilized can be increased by supplementing the device with other pairs of magnets.

The additional pairs of magnets will be distributed with separations or an angular distribution so that the magnets and the integral supports of the item to be stabilized do not form, combined with the fixed magnets (integral with the frame) of the device, the subject of the invention, a closed magnetic circuit, and therefore do not determine any other angular positions of the item to be stabilized 30 corresponding to the state. For instance, additional pairs of magnets like this could be distributed to form unequal intervals between one another so that none of them coincides with the gaps between the two pairs of magnets of the device according to the invention.

However, if there are several permitted positions for the item to be stabilized, it is intended to place on the item to be stabilized 30, for each permitted angular position, a set of similar magnets and metal supports, which when brought to coincide with the fixed part of the device, according to the invention, will be indistinctly detected to be in the "items to be stabilized in one of the permitted angular positions" state.

The advantages can be clearly perceived in the description, in particular underscoring that it is possible to produce, in a safe and economic manner, a means of preventing an item mounted to a rotating device from turning, being inaccessible using conventional mechanical means, and of ensuring of said item:

that it is in a required angular position before the device supporting it is put into rotation.

remains stationary and is maintained in this position.

Such a device is a specific advantage in the case of textile machines transforming yarn using the double twist or direct cabling method, to prevent the starting or accidental rotation of items attached to the rotating devices.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device to maintain stationary, in a required angular position, an item to be stabilized, arranged on a device rotating through a bearing, using the attraction force of a multitude of pairs of magnets placed to face each other, with each pair comprising a magnet integral with the item to be stabilized and a magnet integral with a fixed part, comprising:

at least two pairs of magnets arranged near one another on supports of materials having low reluctance, wherein the device ensures that the item to be stabilized is not put into rotation until the item to be stabilized is in the required angular position, the said pairs of magnets and the said supports forming a closed magnetic circuit except for an air gap, with magnets placed in such a direction that their north and south poles successively alternate with one another along said magnetic circuit, an item, sensitive to a magnetic field, is attached to the fixed part and placed inside the closed magnetic circuit formed when the item to be stabilized is in the required angular position, and in the axis or a radio plane of symmetry of the said circuit, said sensitive item supplies a logic output state corresponding to the "item to be stabilized in the required angular position" when the detected field is less than a predetermined maximum threshold, and a logic state corresponding to the "item to be stabilized being outside the required angular position", when the detected field is greater than the minimum predetermined threshold.

2. The device according to claim 1, wherein the item sensitive to the magnetic field is a Hall effect sensor associated with a processing circuit defining a logic output state according to a threshold level of the measured magnetic field.

3. The device according to claim 1, wherein the item sensitive to the magnetic field is a reed switch with the output logic state defined by the open or closed state of said reed switch.

4. The device according to claim 3, wherein the reed switch is closed when there is no magnetic field and open when there is a magnetic field, said switch being inserted in series with the control circuit of the motor of the rotating device so that the motor is not powered when the said switch is open.

5. The use of the device according to claim 1 in a machine for the transformation of textile yarn according to a double twist method, using a spindle, to which a pot is attached by a bearing, with said pot being rendered inaccessible by yarn put into rotation to form a ball around it, wherein the item to be stabilized is the pot, with a logic state imparted to a means of driving the said spindle in such a way that the logic state corresponding to the "item to be stabilized, that is the pot, in the required angular position" enables rotation and maintaining in rotation of the spindle, and the logic state of the "item to be stabilized, that is the pot, not in the required angular position" prohibits the putting into rotation of the spindle or causes its stoppage if this state appears while it is in rotation.

6. Use of the device according to claim 1 in a machine for the transformation of textile yarn according to a direct wiring process, using a spindle, a rotating regulator, driven by yarn put into rotation to form a ball, and a brake attached to said rotating regulator by means of a bearing, with said brake being rendered inaccessible by the yarn, wherein the item to be stabilized is said brake, with a logic state imparted to a means of driving said spindle in such a way that the logic state corresponding to the "item to be stabilized, that is the brake, in the required angular position" enables rotation and maintaining in rotation of the spindle, and therefore, through the yarn of the ball, the regulator and such that the logic state corresponding to the "item to be stabilized that is the brake, not in the required angular position" prohibits the putting into rotation of the spindle and therefore of the regulator or causes their stoppage if this state appears while they are in rotation.

7. Use of the device according to claim 1 in a machine for the transformation of textile yarn according to a direct cabling method, using a spindle, to which is attached a pot by means of a bearing and rotating regulator, driven by yarn put into rotation to form a ball, and a brake attached to said rotating regulator by a bearing, with said pot and said brake being rendered inaccessible by yarn, wherein the item to be stabilized is said pot and said brake, with a logic state imparted to a means of driving said spindle in such a way that the logic state corresponding to the "items to be stabilized, that is, the pot and the brake, in their required respective angular positions" enables rotation of and maintaining in rotation of the spindle, and therefore, through the yarn of the ball, the regulator, and such that the logic states corresponding to the "item to be stabilized, that is, the pot or the brake, not in the required angular position" prohibits the putting into rotation of the spindle and therefore of the regulator or causes their stoppage if this state appears while they are in rotation.

8. Use of the device according to claim 5, wherein the spindle is combined with a driving device associated with a braking device and the appearance of the "item to be stabilized not in the required angular position" logic state causes the stoppage of the driving device and the actuation of the braking device to ensure a fast stoppage.

* * * * *